US009708851B2

(12) United States Patent
Huang

(10) Patent No.: US 9,708,851 B2
(45) Date of Patent: Jul. 18, 2017

(54) RETARDING DEVICE FOR A CORD OF A WINDOW SHADE

(71) Applicant: Taicang Kingfu Plastic Manufacture Co., LTD., Taicang (CN)

(72) Inventor: Szu-Chang Huang, Changhua County (TW)

(73) Assignee: Taicang Kingfu Plastic Manufacture Co., LTD., Jiangshu Province (CN)

( * ) Notice: Subject to any disclaimer, the term of this patent is extended or adjusted under 35 U.S.C. 154(b) by 0 days.

(21) Appl. No.: 14/798,529

(22) Filed: Jul. 14, 2015

(65) Prior Publication Data

US 2016/0281421 A1 Sep. 29, 2016

(30) Foreign Application Priority Data

Mar. 27, 2015 (CN) ..... 2015 2 0181188 U

(51) Int. Cl.
*E06B 9/324* (2006.01)
*E06B 9/322* (2006.01)
*E06B 9/80* (2006.01)

(52) U.S. Cl.
CPC ..... *E06B 9/324* (2013.01); *E06B 9/322* (2013.01); *E06B 2009/807* (2013.01)

(58) Field of Classification Search
CPC . E06B 9/324; E06B 9/322; E60B 9/38; E60B 2009/807
USPC ..... 188/65.1, 65.4, 65.5; 160/178.2
See application file for complete search history.

(56) References Cited

U.S. PATENT DOCUMENTS 4,039,045 A * 8/1977 Hoger ..... A62B 1/06 182/5
5,535,806 A * 7/1996 Kold ..... E06B 9/40 160/273.1
7,331,370 B1 * 2/2008 Militello ..... E06B 9/322 160/170
2003/0111191 A1 * 6/2003 Ciuca ..... E06B 9/322 160/170
2004/0231803 A1 * 11/2004 Cheng ..... E06B 9/262 160/84.04
2007/0084569 A1 * 4/2007 Lin ..... E06B 9/262 160/173 R
2011/0061823 A1 * 3/2011 Lin ..... E06B 9/262 160/340
2013/0299103 A1 * 11/2013 Anderson ..... E06B 9/24 160/331
2013/0306776 A1 * 11/2013 Lin ..... E06B 9/322 242/157 R
2013/0313497 A1 * 11/2013 Hsu ..... E06B 9/262 254/394

(Continued)

*Primary Examiner* — Xuan Lan Nguyen
(74) *Attorney, Agent, or Firm* — LeClairRyan

(57) ABSTRACT

A retarding device is used to retard movement of a cord of a window shade. The retarding device includes a support frame and a retarding unit. The support frame includes a base part having a base slot formed therethrough, and a side plate disposed at one side of the base part and having a securing portion formed therethrough. The retarding unit includes a cord retarding module, and a rod member disposed at the base slot. The cord retarding module has a mounting seat secured to the securing portion, and a retarding shaft rotatably supported on the mounting seat. The rod member and the retarding shaft are parallel to each other and extend in a longitudinal direction.

10 Claims, 9 Drawing Sheets

(56) References Cited

U.S. PATENT DOCUMENTS

| | | | | |
|---|---|---|---|---|
| 2014/0216663 | A1* | 8/2014 | Lin | E06B 9/262<br>160/84.01 |
| 2014/0217142 | A1* | 8/2014 | Lin | E06B 9/322<br>226/196.1 |
| 2014/0224431 | A1* | 8/2014 | Lin | A47H 5/032<br>160/84.01 |

* cited by examiner

RETARDING DEVICE FOR A CORD OF A WINDOW SHADE

CROSS-REFERENCE TO RELATED APPLICATION

This application claims priority of Chinese Application No. 201520181188.4, filed on Mar. 27, 2015.

FIELD

The disclosure relates to a window shade, and more particularly to a retarding device for a cord of a window shade.

BACKGROUND

In commonly owned and co-pending U.S. patent application Ser. No. 14/555,812, there is disclosed a window shade having a retarder operatively associated with a pull cord. The retarder includes a base member, and two retarding shafts and a rod member that are disposed on the base member and that are horizontally spaced apart from each other. Each retarding shaft includes a core pin retained on the base member, and a roller rotatably sleeved on the core pin. The rod member is disposed below the retarding shafts and is located between the retarding shafts in the horizontal direction. The pull cord extends into the base member, and extends in sequence around one of the retarding shafts, around the other one of the retarding shafts and around the rod member before exiting the base member in a downward direction. The retarder provides a friction force to retard movement of the pull cord.

The entire disclosure of the aforementioned commonly owned and co-pending U.S. Patent Application is incorporated herein in its entirety.

SUMMARY

An object of the disclosure is to provide a retarding device for a cord of a window shade, the retarding device having a durable configuration.

According to the disclosure, a retarding device comprises a support frame and a retarding unit.

The support frame includes a base part having a base slot formed therethrough, and a side plate disposed at one side of the base part and having a securing portion formed therethrough.

The retarding unit includes a cord retarding module having a mounting seat secured to the securing portion, and a retarding shaft rotatably supported on the mounting seat. The retarding unit further includes a rod member disposed on the base part at the base slot.

The rod member and the retarding shaft are parallel to each other and extend in a longitudinal direction.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
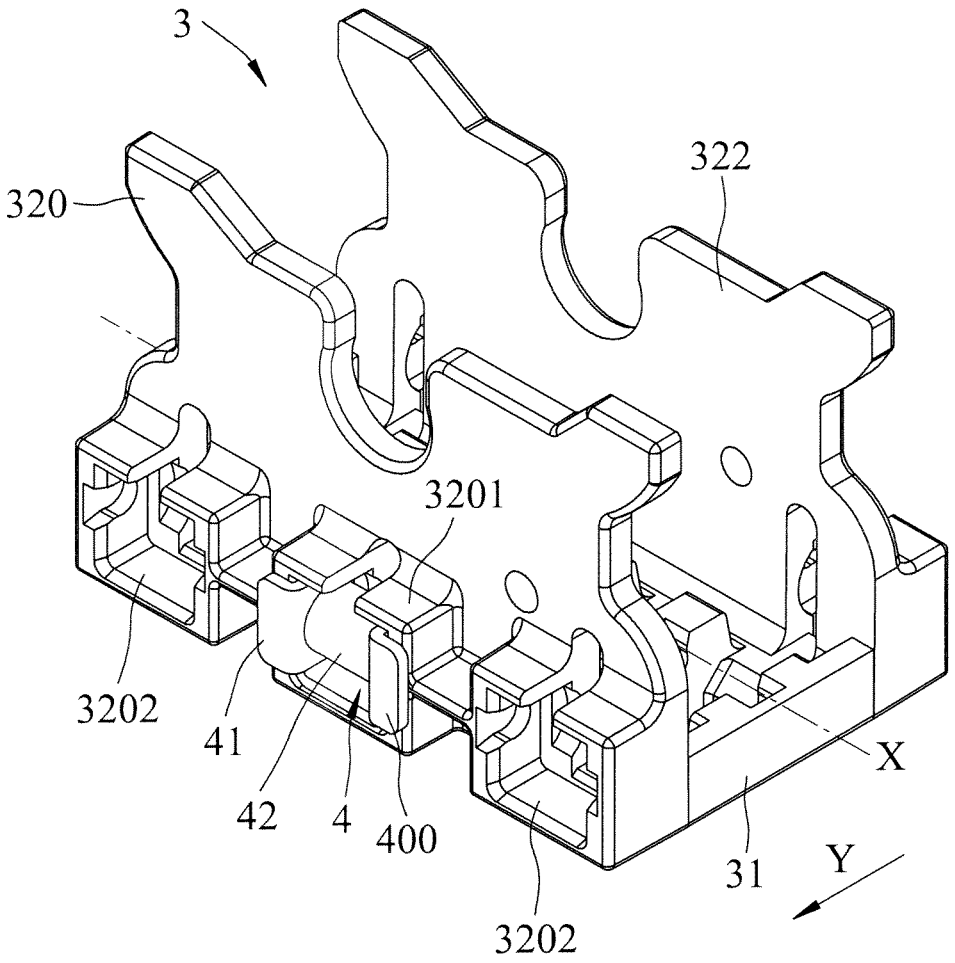
FIG. 1 is a perspective view illustrating a first embodiment of a retarding device for a cord of a window shade according to the disclosure.

Before the disclosure is described in greater detail, it should be noted that like elements are denoted by the same reference numerals throughout the disclosure.

Figure 2:
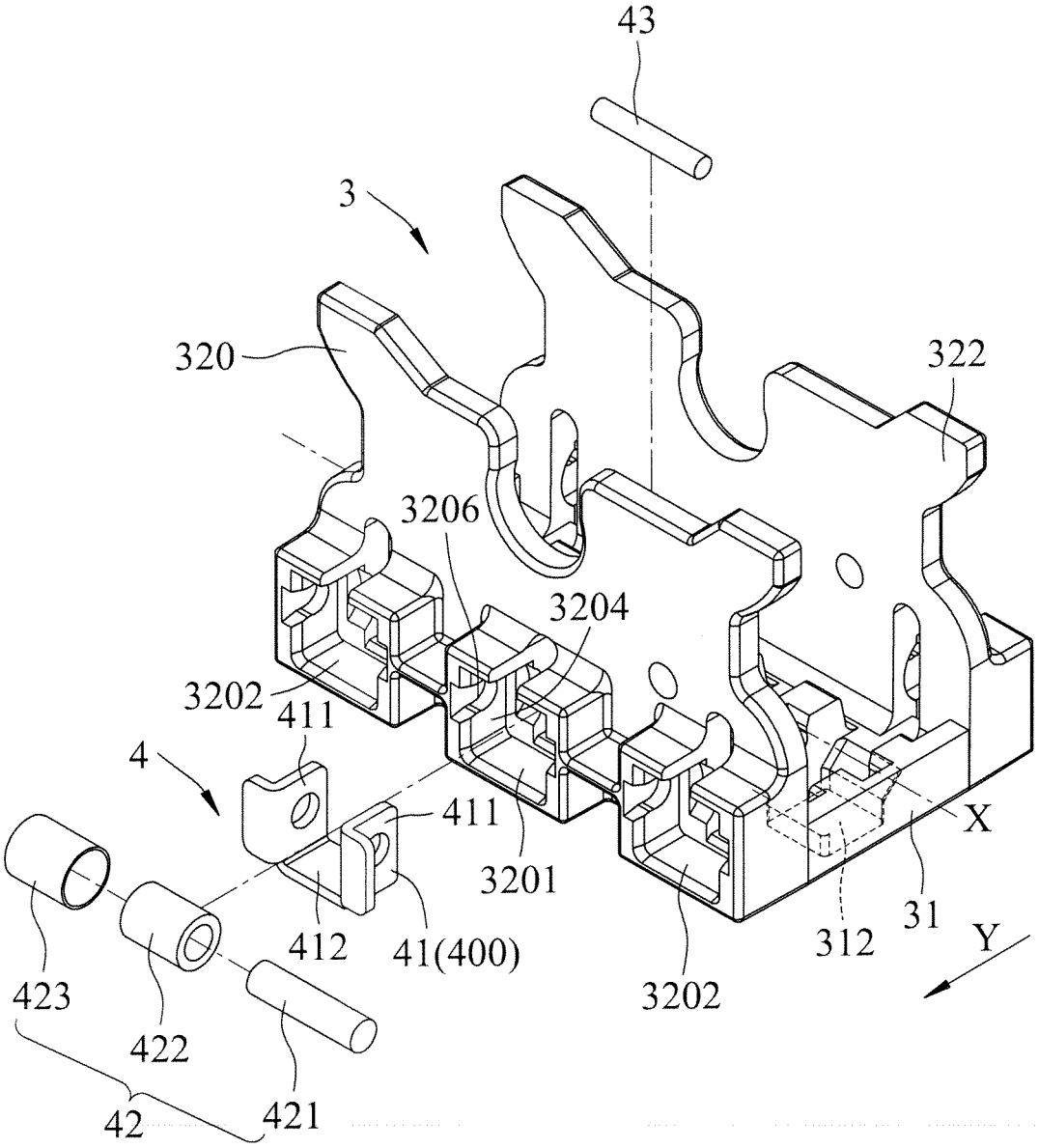
FIG. 2 is an exploded perspective view of the first embodiment.
Figure 3:
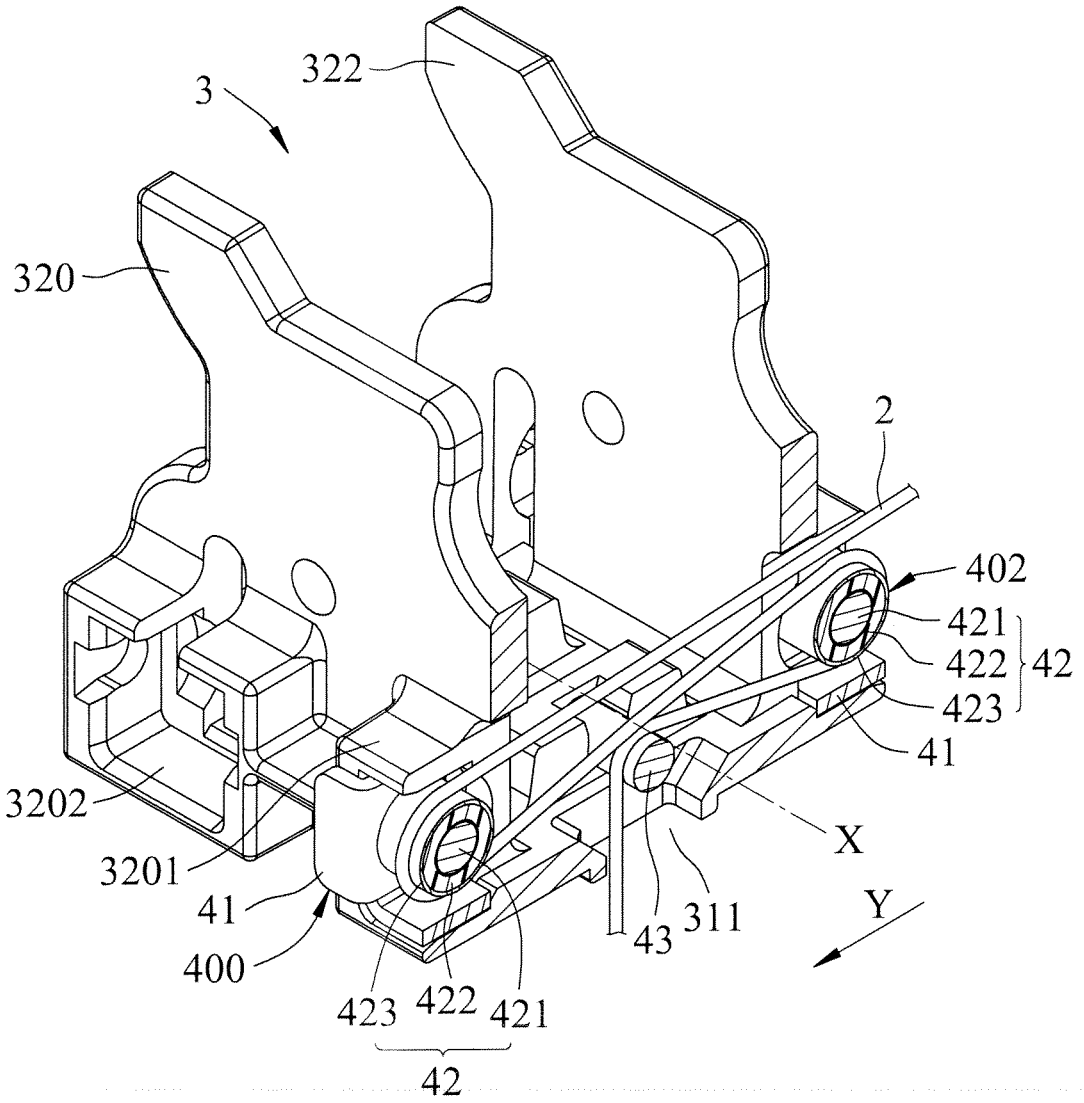
FIG. 3 is a perspective partly cutaway view of the first embodiment to illustrate how a pull cord is wound around a retarding unit.

Referring to FIGS. 1 to 3, the first embodiment of a retarding device according to the disclosure is adapted for retarding movement of a cord 2 in a window shade, such as a pull cord of a window shade disclosed in the aforementioned commonly owned and co-pending U.S. Patent Application. In this embodiment, the retarding device includes a support frame 3 and a retarding unit 4.

The support frame 3 includes a base part 31 and first and second side plates 320, 322.

In this embodiment, the base part 31 extends along a longitudinal direction (X) and has a first base slot 311 and two reserve base slots 312 (only one is visible in FIG. 2) that extend from a top surface through a bottom surface of the base part 31. The reserve base slots 312 are spaced apart from each other in the longitudinal direction (X) and are disposed on opposite sides of the first base slot 311 in the longitudinal direction (X).

In this embodiment, the first and second side plates 320, 322 extend along the longitudinal direction (X) and are respectively disposed on opposite sides of the base part 31 in a transverse direction (Y) transverse to the longitudinal direction (X). The first side plate 320 is formed with a first securing portion 3201 and two reserve securing portions 3202. The reserve securing portions 3202 are spaced apart from each other in the longitudinal direction (X) and are disposed on opposite sides of the first securing portion 3201 in the longitudinal direction (X). Although not visible in FIGS. 1 and 2, the second side plate 322 is formed with a second securing portion 3221 (see FIG. 4) and two reserve securing portions corresponding to the first securing portion 3201 and the reserve securing portions 3202 of the first side plate 320. The first securing portion 3201 and the second securing portion 3221 extend in the longitudinal direction (X) and are symmetrically disposed on opposite sides of the first base slot 311 in the transverse direction (Y).

In this embodiment, the retarding unit 4 includes first and second cord retarding modules 400, 402 and a rod member 43. Each of the first and second cord retarding modules 400, 402 includes a mounting seat 41 and a retarding shaft 42. The mounting seat 41 of the first cord retarding module 400 is secured to the first securing portion 3201 of the first side plate 320. The mounting seat 41 of the second cord retarding module 402 is secured to the second securing portion 3221 of the second side plate 322.

In this embodiment, each of the first securing portion 3201 and the second securing portion 3221 defines a retaining space, and the mounting seat 41 of each of first cord retarding module 400 and the second cord retarding module 402 is fittingly retained in the retaining space of the corresponding first securing portion 3201 or second securing portion 3221 but may be forcibly removed therefrom. However, the present disclosure is not limited in this respect.

For each of the first and second cord retarding modules 400, 402, the retarding shaft 42 is rotatably supported on the corresponding mounting seat 41 and includes a core pin 421, a roller 422 rotatably sleeved on the core pin 421, and a protective sleeve 423 intimately sleeved on the roller 422.

In this embodiment, for each of the first and second cord retarding modules 400, 402, the mounting seat 41 has a pair of arm portions 411 spaced apart from each other in the longitudinal direction (X), and a connecting portion 412 that interconnects the arm portions 411.

In this embodiment, each of the first securing portion 3201 and the second securing portion 3221 has an opposing pair of wall parts 3204 respectively proximate to the arm portions 411 of the mounting seat 41 of the corresponding first cord retarding module 400 or second cord retarding module 402. Each of the first securing portion 3201 and the second securing portion 3221 further has an aligned pair of pin grooves 3206 each formed in a respective one of the wall parts 3204 and each extending in the transverse direction (Y). Moreover, the core pin 421 of the retarding shaft 42 of each of the first cord retarding module 400 and the second cord retarding module 402 has opposite ends that extend through the arm portions 411 of the corresponding mounting seat 41 and that are fittingly and respectively retained in the pin grooves 3206 of the corresponding first securing portion 3201 or second securing portion 3221 but may be forcibly removed therefrom. However, the present disclosure is not limited in this respect. For example, the pin ends of the core pin 421 may be non-fittingly retained in the pin grooves 3206. Moreover, the core pin 421 may or may not be rotatable relative to the corresponding mounting seat 41.

The rod member 43 extends in the longitudinal direction (X) and is disposed on the base part 31 at the first base slot 311. The rod member 43 and the retarding shafts 42 of the first and second cord retarding modules 400, 402 are parallel to each other.

Figure 4:
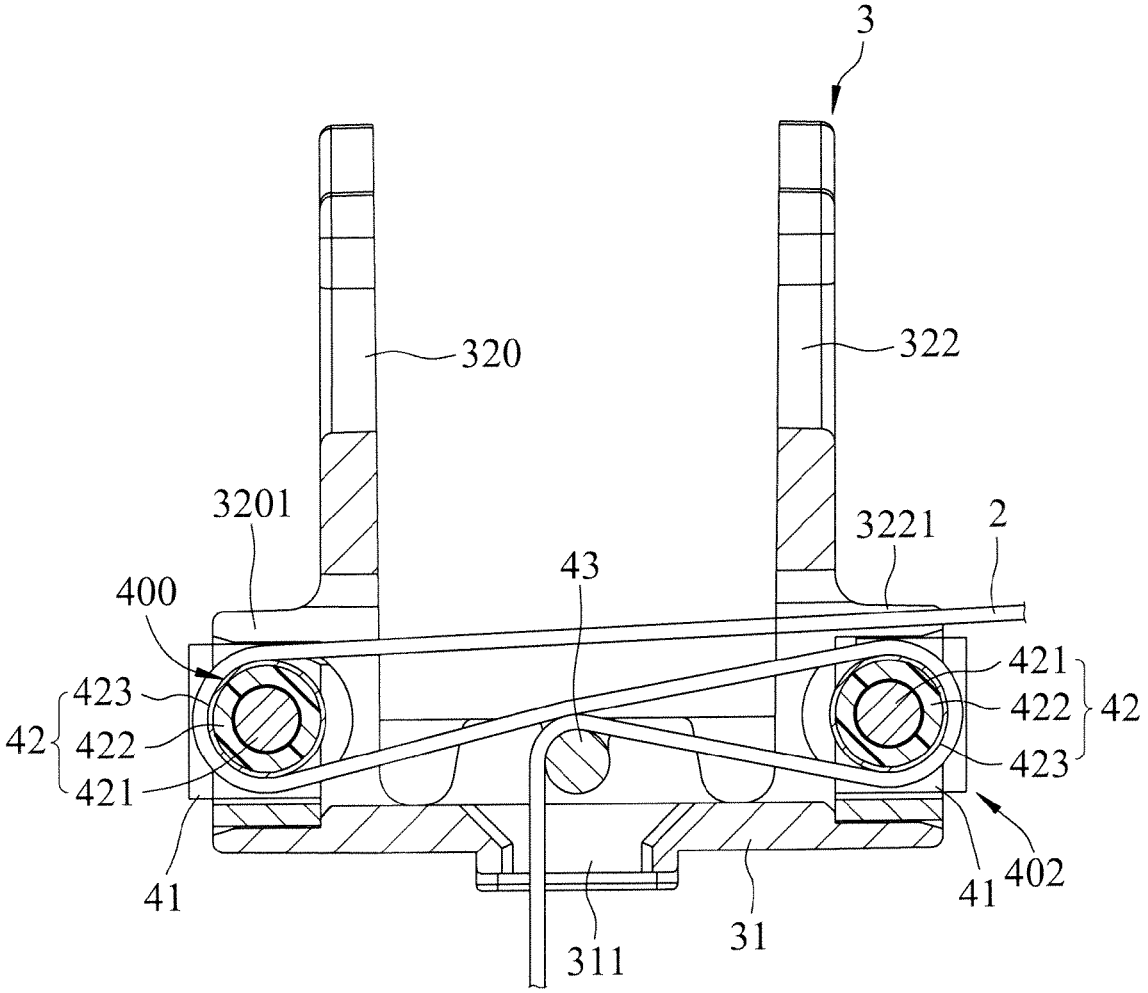
FIG. 4 is a schematic sectional view of the first embodiment to illustrate the pull cord wound around the retarding unit.

Referring to FIG. 4, the cord 2, which may be exemplified as a pull cord of a window shade in this embodiment, may be wound around the retarding unit 4 in the following manner so that the retarding unit 4 may provide a friction force to retard movement of the cord 2 and thereby ensure proper operation of the window shade. After extending through the second securing portion 3221, the cord 2 is wound in sequence around the retarding shaft 42 of the first cord retarding module 400, around the retarding shaft 42 of the second cord retarding module 402 and around the rod member 43 before exiting downwardly via the first base slot 311. It should be noted that the aforesaid winding manner is illustrative, and the present disclosure is not limited to a specific winding manner of the cord 2 on the retarding unit 4.

Preferably, the mounting seats 41 and the protective sleeves 423 are made of metal having characteristics of rigidity and good thermal conductivity. The core pins 421 may be made of metal, and the rollers 422 may be made of plastic. Since the protective sleeves 423, which are directly in contact with the cord 2, are made of metal, resistance to wear of the retarding shafts 42 may be promoted and heat generated as a result of friction may be quickly dissipated so as to alleviate deformation of the rollers 422 and result in a longer service life. Moreover, since the mounting seats 41 are made of metal, they are able to withstand greater stress, are able to stably and securely support the retarding shafts 42, and are able to assist in heat dissipation. As a result, deformation of the mounting seats 41 and the side plates 320, 322 may be alleviated, and the positions of the core pins 421 may maintained to ensure smooth rotation of the retarding shafts 42 and avoid jamming of the cord 2 or the retarding shafts 42 that may affect smooth operation and service life of the window shade.

It is noted that the reserve base slots 312 and the reserve securing portions of the first and second side plates 320, 322 may be omitted in a modification of the first embodiment.

Figure 5:
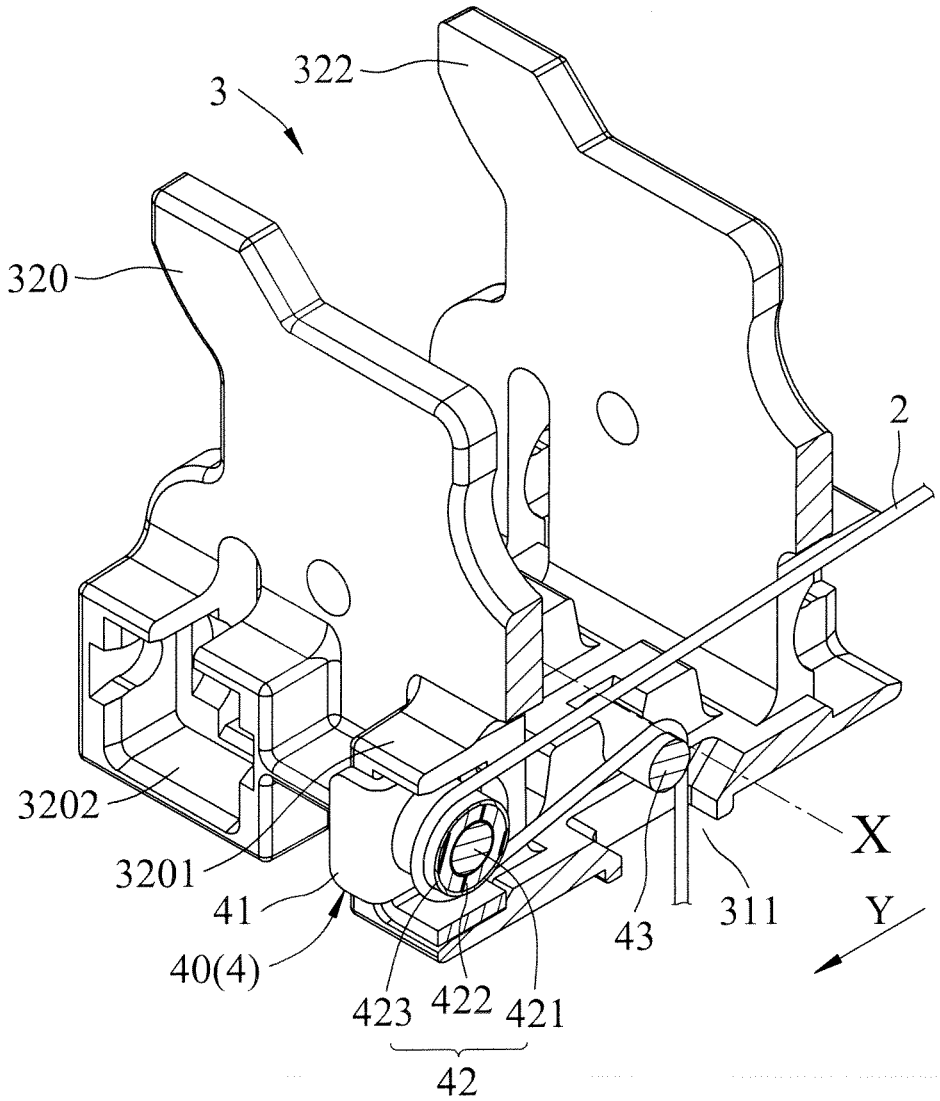
FIG. 5 is a perspective partly cutaway view illustrating an implementation of a second embodiment of the retarding device according to the disclosure.
Figure 6:
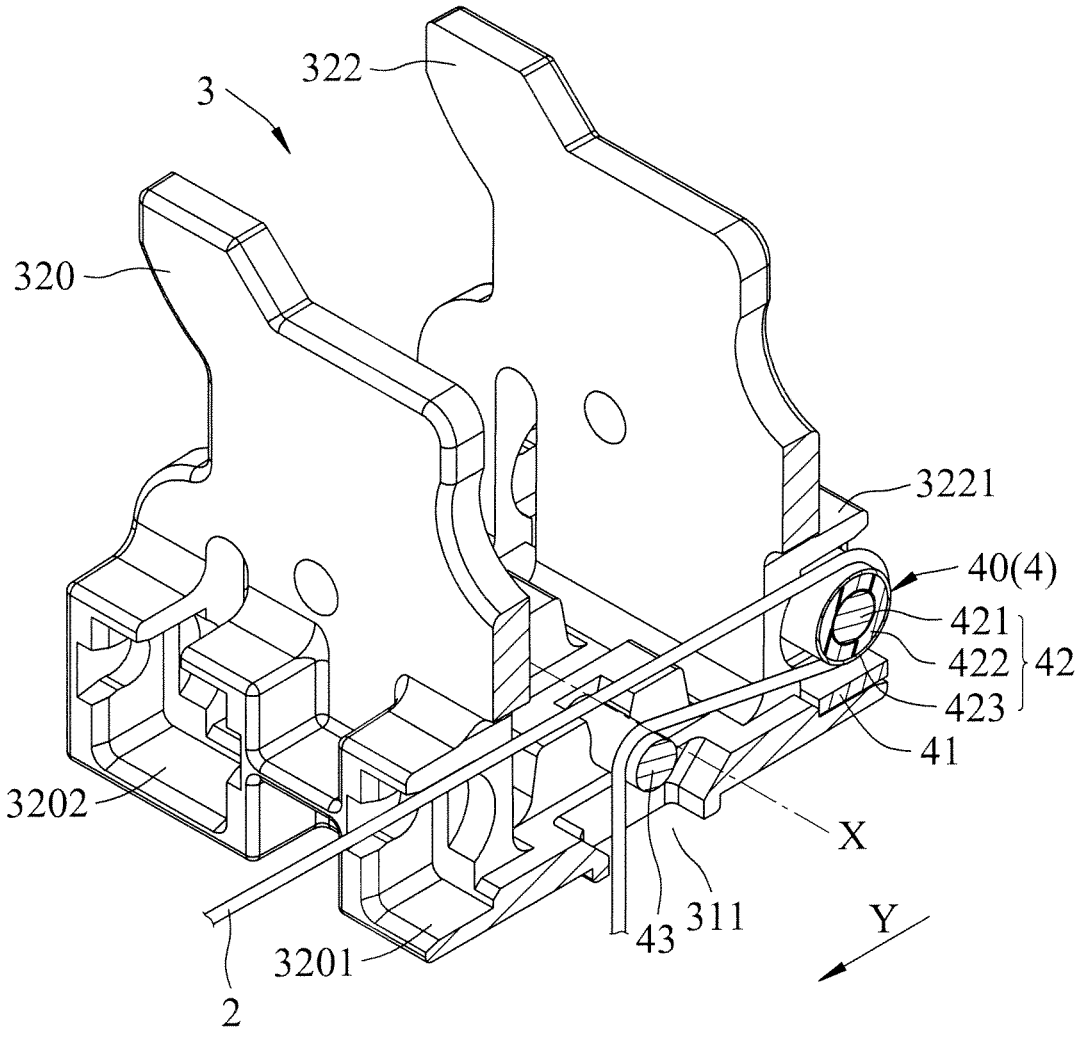
FIG. 6 is a perspective partly cutaway view illustrating another implementation of the second embodiment.

Referring to FIGS. 5 and 6, the second embodiment of the retarding device according to the disclosure is shown to be similar to the first embodiment. In this embodiment, however, the retarding unit 4 includes the rod member 43 and only one cord retarding module 40. The mounting seat 41 of the cord retarding module 40 is secured to the first securing portion 3201 (see the implementation illustrated in FIG. 5) or the second securing portion 3221 (see the implementation illustrated in FIG. 6), and the retarding shaft 42 of the cord retarding module 40 is rotatably supported on the mounting seat 41. The rod member 43 is disposed on the base part 31 at the first base slot 311, extends in the longitudinal direction (X), and extends parallel to the retarding shaft 42.

In each of the two implementations of the second embodiment respectively illustrated in FIGS. 5 and 6, the cord retarding module 40 is assembled to a desired one of the first and second side plates 320, 322, and the cord 2 extends in sequence around the retarding shaft 42 and around the rod member 43 before exiting downward via the first base slot 311. The winding manners of the cord 2 as exemplified in FIGS. 5 and 6 are illustrative, and the present disclosure is not limited in this respect.

The second embodiment may achieve the same advantages as the first embodiment.

Figure 7:
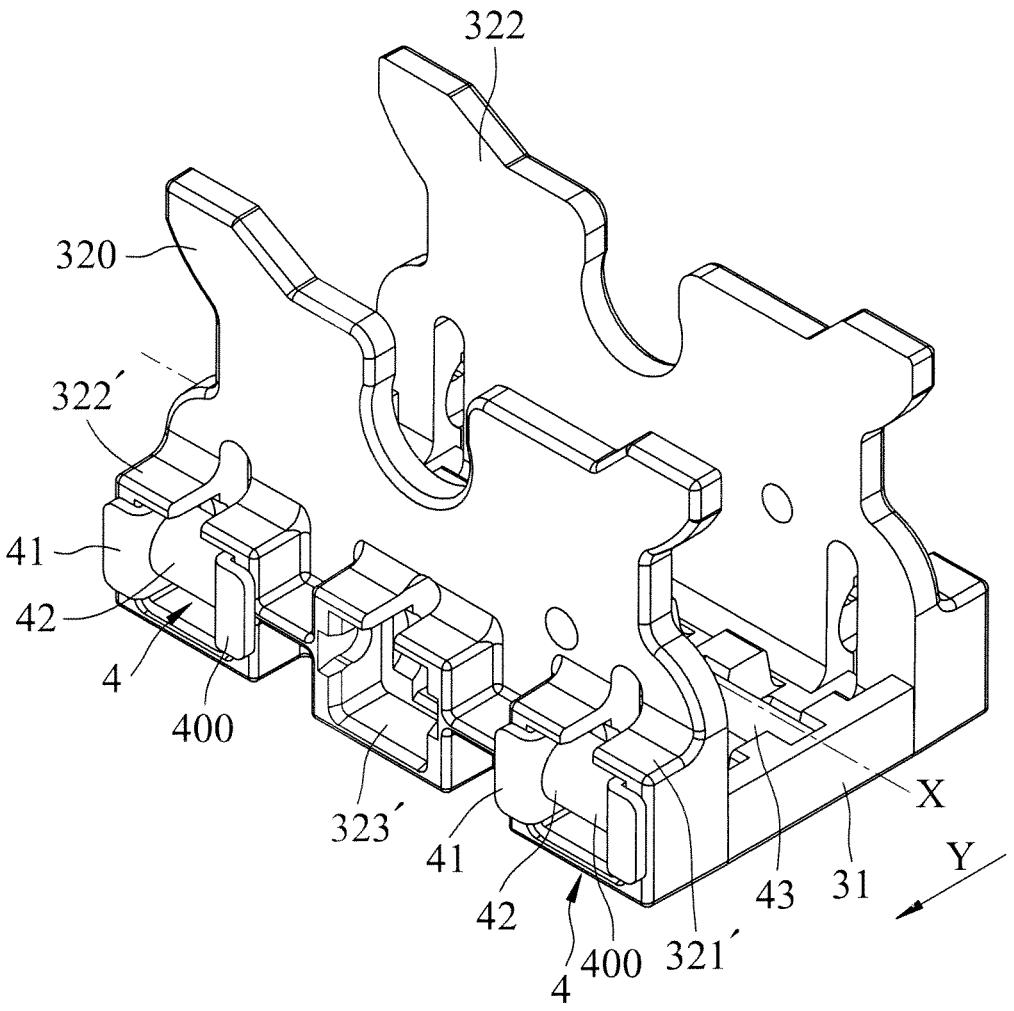
FIG. 7 is a perspective view illustrating a third embodiment of the retarding device according to the disclosure.
Figure 8:
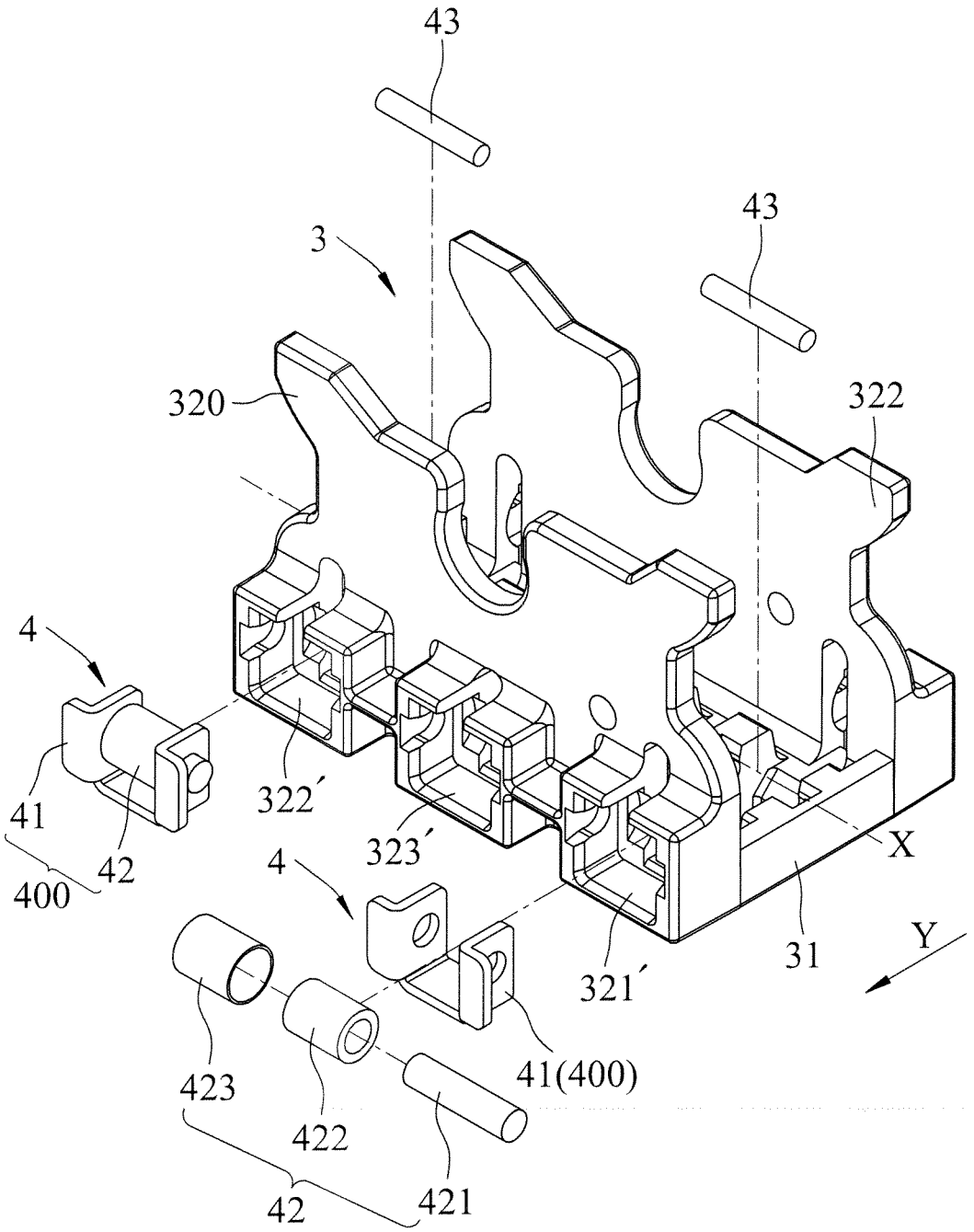
FIG. 8 is an exploded perspective view of the third embodiment.
Figure 9:
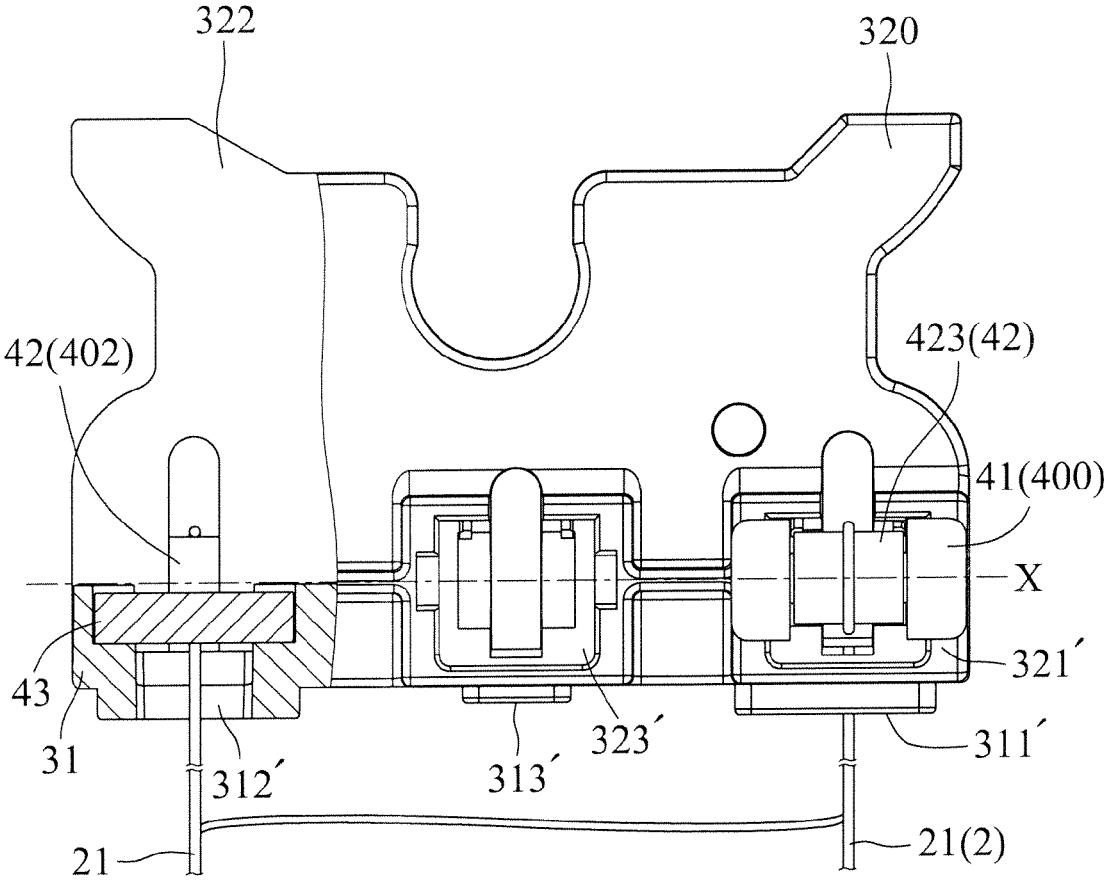
FIG. 9 is a schematic partly sectional view to illustrate the third embodiment in a state of use.

Referring to FIGS. 7 to 9, the third embodiment of the retarding device according to the disclosure is shown. In this embodiment, the cord 2 of the window shade is exemplified as a ladder cord having two parallel cord segments 21 (see FIG. 9).

The retarding device of this embodiment includes a support frame 3 and first and second retarding units 4.

The support frame 3 includes abase part 31 and first and second side plates 320, 322. The base part 31 extends along a longitudinal direction (X) and has a first base slot 311', a second base slot 312' and a third base slot 313' that extend from a top surface through a bottom surface of the base part 31. The first and second base slots 311', 312' are spaced apart from each other in the longitudinal direction (X) and are disposed on opposite sides of the third base slot 313' in the longitudinal direction (X).

In this embodiment, the first and second side plates 320, 322 extend along the longitudinal direction (X) and are respectively disposed on opposite sides of the base part 31 in a transverse direction (Y) transverse to the longitudinal direction (X). Each of the first and second side plates 320, 322 is formed with a first securing portion 321', a second securing portion 322' and a third securing portion 323'. For each of the side plates 320, 322, the first securing portion 321' and the second securing portion 322' are spaced apart from each other in the longitudinal direction (X) and are disposed on opposite sides of the first securing portion 321' in the longitudinal direction (X). The first securing portions 321' of the first and second side plates 320, 322 extend in the longitudinal direction (X) and are symmetrically disposed on opposite sides of the first base slot 311' in the transverse direction (Y). The second securing portions 322' of the first and second side plates 320, 322 are symmetrically disposed on opposite sides of the second base slot 312' in the transverse direction (Y), and the third securing portions 323' of the first and second side plates 320, 322 are symmetrically disposed on opposite sides of the third base slot 313' in the transverse direction (Y).

The components of each of the first and second retarding units 4 in this embodiment are similar to those of the retarding unit 4 in the first embodiment. Therefore, in this embodiment, each of the first and second retarding units 4 includes first and second cord retarding modules 400, 402 and a rod member 43. The difference with the first embodiment resides in the assembly locations of the first and second retarding units 4.

In this embodiment, the mounting seats 41 of the first and second cord retarding modules 400, 402 of the first retarding unit 4 are secured to the first securing portions 321' of the first and second side plates 320, 322, respectively. The mounting seats 41 of the first and second cord retarding modules 400, 402 of the second retarding unit 4 are secured to the second securing portions 322' of the first and second side plates 320, 322, respectively.

Like the first embodiment, the retarding shaft 42 of each cord retarding module 400, 402 is rotatably supported on the corresponding mounting seat 41 and includes a core pin 421, a roller 422 rotatably sleeved on the core pin 421, and a protective sleeve 423 intimately sleeved on the roller 422.

Since the manner of assembling the retarding shafts 42 to the mounting seats 41 and the manner of assembling the mounting seats 41 to the securing portions 321', 322' are similar to those previously described in connection with the first embodiment, further details of the same will be omitted herein for the sake of brevity.

The rod member 43 of the first retarding unit 4 extends in the longitudinal direction (X) and is disposed on the base part 31 at the first base slot 311'. The rod member 43 of the second retarding unit 4 extends in the longitudinal direction (X) and is disposed on the base part 31 at the second base slot 312'. For each of the first and second retarding units 4, the rod member 43 and the retarding shafts 42 of the cord retarding modules 40 are parallel to each other.

It should be noted that the materials used for the various components of the cord retarding modules 400, 402 may be the same as those used in the first embodiment.

Moreover, the cord segments 21 of the cord 2 may be respectively wound around the first and second retarding units 4 in a manner similar to that employed in the winding of the cord 2 in the first embodiment. The cord segments 21 are kept mutually parallel, exit downwardly via the first base slot 311' and the second base slot 312', respectively, and are able to move synchronously.

Unlike the first embodiment, since the third embodiment is operably associated with two cord segments 21 of the cord 2, the third embodiment uses first and second retarding units 4.

It should be noted that the third base slot 313' and the third securing portions 323' of the first and second side plates 320, 322 may be omitted in a modification of the third embodiment.

In another modification of the third embodiment, each of the first and second retarding units 4 may have the configuration of the retarding unit 4 of the second embodiment.

It should be apparent from the foregoing that the support frame 3 employed in the aforementioned three embodiments may be made from the same mold to simplify manufacture and reduce fabrication costs of the different embodiments of the retarding device of this disclosure. Moreover, the appearance of the support frame 3, such as the shape and size of the side plates 320, 322, the thickness of the base plate 31, the locations and numbers of the base slots 311, 312, 311', 312', 313', the locations and numbers of the securing portions 3201, 3202, 3221, 321', 322', 323', etc., may be adjusted to meet actual requirements without compromising achievement of the effects disclosed herein.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A retarding device for a cord of a window shade, said retarding device comprising:

a support frame including a base part having a first base slot formed therethrough, and a first side plate disposed at one side of said base part and having a first securing portion formed therethrough; and a first retarding unit including a first cord retarding module having a mounting seat secured to said first securing portion, and a retarding shaft rotatably supported on said mounting seat, and a first rod member disposed on said base part at said first base slot;

wherein said first rod member and said retarding shaft of said first cord retarding module are parallel to each other and extend in a first direction;

wherein said retarding shaft of said first cord retarding module includes a core pin, a roller rotatably sleeved on said core pin, and a protective sleeve sleeved on said roller.

2. The retarding device according to claim 1, wherein said protective sleeve is made of metal.

3. The retarding device according to claim 2, wherein said core pin is made of metal and said roller is made of plastic.

4. The retarding device according to claim 1, wherein said first securing portion defines a retaining space, and said mounting seat of said first cord retarding module is fittingly retained in said retaining space of said first securing portion.

5. The retarding device according to claim 4, wherein said mounting seat of said first cord retarding module has a pair of arm portions spaced apart from each other in the first direction, and a connecting portion that interconnects said arm portions.

6. The retarding device according to claim 5, wherein: said first securing portion has an opposing pair of wall parts respectively proximate to said arm portions, and an aligned pair of pin grooves each formed in a respective one of said wall parts and each extending in a second direction transverse to the first direction; and said core pin of said retarding shaft has opposite pin ends that extend through said arm portions of said mounting seat and that are respectively retained in said pin grooves.

7. The retarding device according to claim 6, wherein said pin ends are fittingly retained in said pin grooves.

8. The retarding device according to claim 1, wherein:

said support frame further includes a second side plate disposed at another side of said base part opposite to said first side plate and having a second securing portion formed therethrough; and said first retarding unit further includes a second cord retarding module having a mounting seat secured to said second securing portion, and a retarding shaft rotatably supported on said mounting seat of said second cord retarding module;

wherein said first rod member, said retarding shaft of said first cord retarding module and said retarding shaft of said second cord retarding module are parallel to each other and extend in the first direction.

9. The retarding device according to claim 1, wherein:

said base part further has an additional base slot formed therethrough, said additional base slot being spaced apart from said first base slot in the first direction;

said first side plate further has an additional securing portion formed therethrough, said additional securing portion being spaced apart from said first securing portion in the first direction; and said retarding device further includes an additional retarding unit, said additional retarding unit including a first additional cord retarding module having a mounting seat secured to said additional securing portion of said first side plate, and a retarding shaft rotatably supported on said mounting seat of said first additional cord retarding module, and an additional rod member disposed on said base part at said additional base slot;

wherein said first rod member, said additional rod member, said retarding shaft of said first cord retarding module and said retarding shaft of said first additional cord retarding module are parallel to each other and extend in the first direction.

10. The retarding device according to claim 1, wherein said mounting seat is made of metal.

* * * * *